US006043754A

United States Patent [19]

Ishida

[11] Patent Number: 6,043,754

[45] Date of Patent: Mar. 28, 2000

[54] RADIO PAGING RECEIVER HAVING AN ADDITIONAL FUNCTION REQUIRING SETTING WORK

[75] Inventor: Hiromichi Ishida, Shizuoka, Japan

[73] Assignee: NEC Corporation, Tokyo, Japan

[21] Appl. No.: 08/869,062

[22] Filed: Jun. 4, 1997

[30] Foreign Application Priority Data

Jun. 12, 1996 [JP] Japan ..... 8-151352

[51] Int. Cl.[7] ..... G08B 5/22

[52] U.S. Cl. ..... 340/825.44; 340/825.69; 455/38.1

[58] Field of Search ..... 340/825.44, 825.54, 340/825.69, 825.72, 825.8; 371/32, 33; 455/38.1

[56] References Cited

U.S. PATENT DOCUMENTS 4,875,038 10/1989 Siwiak et al. ..... 340/825.44
5,473,316 12/1995 Takaya ..... 340/686

FOREIGN PATENT DOCUMENTS 4-172582 6/1992 Japan .

*Primary Examiner*—Michael Horabik
*Assistant Examiner*—Anthony A. Asongwed
*Attorney, Agent, or Firm*—Scully, Scott, Murphy & Presser

[57] ABSTRACT

A radio paging receiver comprises a key input unit including an additional function setting switch and a message confirming switch. A closeable cover is provided on the receiver housing for covering at least the additional function setting switch, and a cover switch and circuit detects opening and closing of the cover. A control unit switches between a first operation mode when the cover is closed of receiving and notifying the user of a paging request, and a second operation mode when the cover is open which allows completion of a partially performed operation of setting the additional function. Thus, the notification operation is delayed or held in the second operation mode when a paging request is received during setting of the additional function, and the receiver then returns to the first operation mode to allow the notification operation which has been delayed or held.

10 Claims, 5 Drawing Sheets

RADIO PAGING RECEIVER HAVING AN ADDITIONAL FUNCTION REQUIRING SETTING WORK

BACKGROUNDS OF THE INVENTION

1. Field of the Invention

The present invention relates to a radio paging receiver for receiving a paging request from a radio base station in a system of paging someone by radio from a radio base station, through access to the radio base station, for example, via a general telephone network of subscribers, and more particularly, to a radio paging receiver having an additional function requiring setting work (hereinafter, referred to as a radio pager).

2. Description of the Related Art

In conventional radio pagers of this kind, there has been a radio pager including an additional function (for example, registration into a telephone directory) as well as a receiving function of receiving a paging request from a radio base station. FIG. 6 shows an example of this kind of the conventional radio pager.

A radio pager as shown in FIG. 6 comprises a key input unit 610 for entering various data or commands, an antenna 690, a receiving unit 620, and a decoder 630 for receiving a paging request from a radio base station, a drive circuit 660, a display unit 670, and a speaker 680 for notifying an operator of the paging request, a control unit 640 for controlling each operation of these units, and an ID-ROM 650 with the ID code of the same radio pager stored therein. When a radio base station transmits a message, the receiving unit 620 receives it through the antenna 690, and the decoder 630 decodes the received message. The control unit 640 makes a comparison between the ID code attached to the received message and that one stored in the ID-ROM 650, and if they are in accord with each other, the control unit 640 controls the drive circuit 660 so as to notify an operator that the message has been received in a manner of displaying it on the display unit 670 and with a sound from the speaker 680. When setting the additional function, necessary data or command is entered with a key from the key input unit 610. Upon receipt of the input from the key input unit 610, the control unit 640 sets the corresponding additional function and stores the setting content into a given storage.

When receiving a paging request from a radio base station during setting of the additional function, the conventional radio pager interrupts the operation accompanied by the setting work of the additional function, then moving to the operation of notifying the receipt of the paging request by means of the display unit 670 and the speaker 680. At this time, the content of the setting work which has been done so far is to be abandoned.

Since the notification operation of the message has priority over the setting operation of the additional function in the conventional radio pager as mentioned above, the setting work which has been done so far is not used if a paging request is received during the setting work of the additional function.

The related technique is found in a data processor disclosed in Japanese Unexamined Patent Publication (Kokai) No. Heisei 4-172582, "An Electronic Device".

SUMMARY OF THE INVENTION

An object of the present invention is to provide a radio pager capable of preventing the loss of the setting work which has having been done so far, if a paging request is received during the setting work of the additional function, by continuing the setting work of the additional function while holding the information of the paging request, and after the completion of the setting work, performing the notification operation of the paging request which has been held.

Another object of the present invention is to provide a radio pager which can be used flexibly depending on the manner of an operator, his purpose, environment, or other condition, by enabling an operator to set the timing of the notification operation of a paging request received during the setting work of the additional function.

According to one aspect of the invention, a radio paging receiver having a function of receiving a paging request from a radio base station and an additional function set by an operator, comprises receiving means for receiving a paging request from the radio base station, notification means for notifying an operator of the paging request, key input means including an additional function setting switch for setting the additional function and a message confirming switch for confirming a received message, cover provided on a case body in an openable way for covering at least the additional function setting switch, cover switching detecting means for detecting opening and closing of the cover, and control means for controlling each operation of these means, wherein the control means operates depending on a detection result by the cover switching detecting means, namely, turning to a first operation mode of receiving and notifying the paging request when the cover is closed and turning to a second operation mode of setting the additional function when the cover is open, and holds an operation of paging request receiving notification, when the receiving means receives a paging request in the second operation mode, for completing the setting of the additional function in the second operation mode, then returning to the first operation mode for carrying out the operation of the paging request receiving notification which has been held.

The control means may selectively control, according to the setting by an operator, the way of automatically starting the operation of the paging request receiving notification which has been held, on condition that it has turned from the second operation mode to the first operation mode by closing the cover which has been open, and the way of starting the operation of the paging request receiving notification which has been held, according to the operation of the message confirming switch by an operator, after turning from the second operation mode to the first operation mode by closing the cover which has been open.

The notification means includes a display means for displaying a received message and a sound notification means for notifying the receipt of a paging request with a sound, and the control means automatically starts the operation of the paging request receiving notification which has been held by the use of the sound by the sound notification means, on condition that it has turned from the second operation mode to the first operation mode by closing the cover which has been open, and after turning from the second operation mode to the first operation mode, it makes the display means display the received message according to the operation of the message confirming switch by an operator.

In the preferred construction, according to the setting by an operator, the control means controls the way of switching between the first operation mode and the second operation mode on the basis of a switching operation by an operator, instead of the way of switching between the first operation mode and the second operation mode on the basis of a result of detecting the opening and closing state of the cover by the cover switching detecting means.

In the preferred construction, the cover switching detecting means includes photoelectric switch provided in the portion of the case body to be covered with the cover for detecting brightness of the space to be covered with the cover, and detecting circuit for judging whether the cover is being open or being closed depending on the brightness detected by the photoelectric switch.

Also, the control means, according to the setting by an operator, controls the way of switching between the first operation mode and the second operation mode on the basis of a switching operation by an operator, instead of the way of switching between the first operation mode and the second operation mode on the basis of a result of detecting the opening and closing state of the cover by the cover switching detecting means, and automatically starts the operation of the paging request receiving notification which has been held, on condition that it has turned from the second operation mode to the first operation mode by closing the cover which has been open.

In another preferred construction, the control means, according to the setting by an operator, controls the way of switching between the first operation mode and the second operation mode on the basis of a switching operation by an operator, instead of the way of switching between the first operation mode and the second operation mode on the basis of a result of detecting the opening and closing state of the cover by the cover switching detecting means, and starts the operation of the paging request receiving notification which has been held, according to the operation of the message confirming switch by an operator, after turning from the second operation mode to the first operation mode by closing the cover which has been open.

Also, the control means, according to the setting by an operator, controls the way of switching between the first operation mode and the second operation mode on the basis of a switching operation by an operator, instead of the way of switching between the first operation mode and the second operation mode on the basis of a result of detecting the opening and closing state of the cover by the cover switching detecting means, and further the control means selectively controls, according to the setting by an operator, the way of automatically starting the operation of the paging request receiving notification which has been held, on condition that it has turned from the second operation mode to the first operation mode by closing the cover which has been open, and the way of starting the operation of the paging request receiving notification which has been held, according to the operation of the message confirming switch by an operator, after turning from the second operation mode to the first operation mode by closing the cover which has been open.

Other objects, features and advantages of the present invention will become clear from the detailed description given herebelow.

BRIEF DESCRIPTION OF THE DRAWINGS

The present invention will be understood more fully from the detailed description given herebelow and from the accompanying drawings of the preferred embodiment of the invention, which, however, should not be taken to be limitative to the invention, but are for explanation and understanding only.

In the drawings.

DESCRIPTION OF THE PREFERRED EMBODIMENT

The preferred embodiment of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to unnecessary obscure the present invention.

Figure 1:
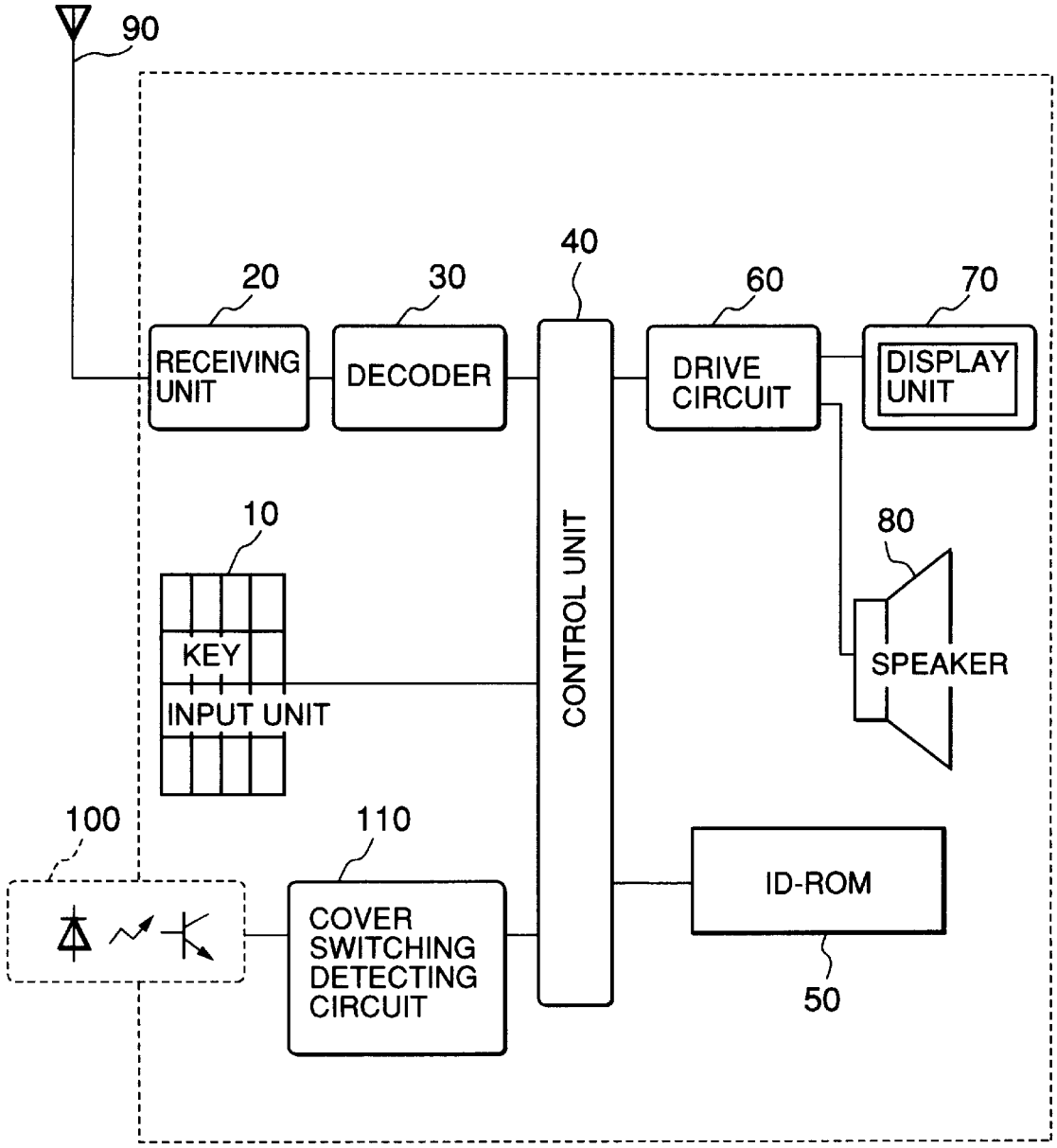
FIG. 1 is a block diagram showing a construction of a radio pager according to an embodiment of the present invention.
Figure 2:
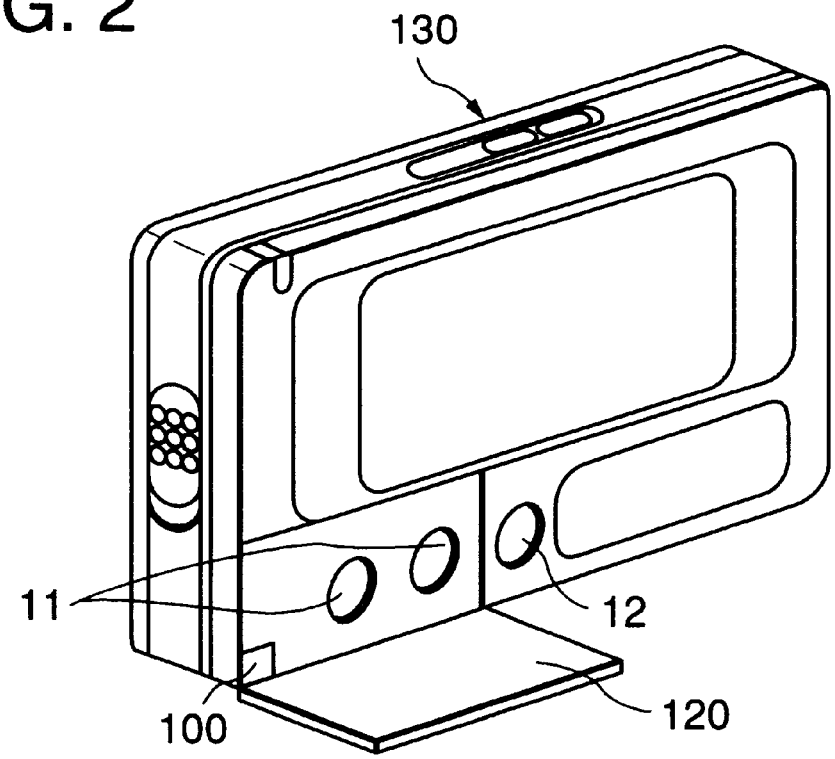
FIG. 2 is a perspective view showing the appearance of the radio pager of the embodiment with the cover open.
Figure 3:
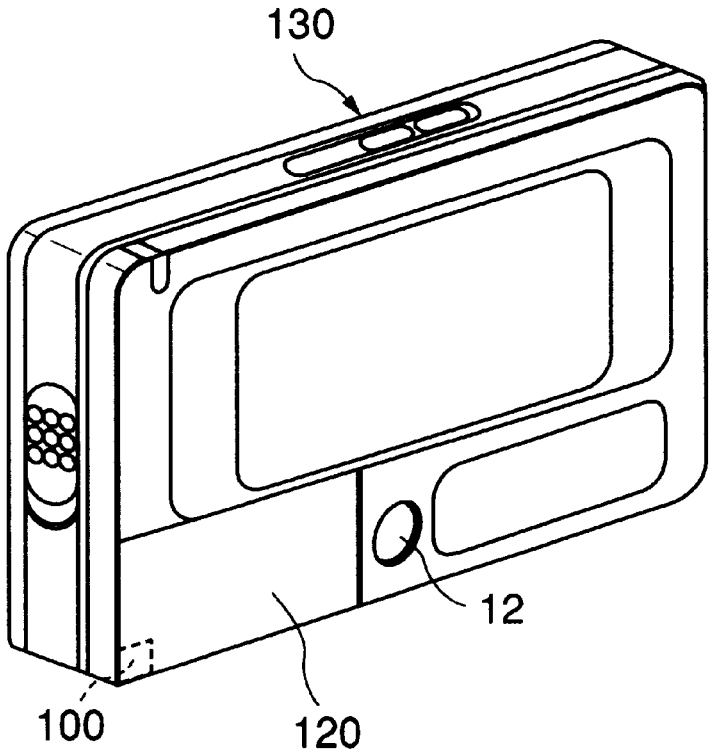
FIG. 3 is a perspective view showing the appearance of the radio pager of the embodiment with the cover closed.

FIG. 1 is a block diagram showing a construction of a radio pager according to an embodiment of the present invention. FIGS. 2 and 3 are perspective views showing the appearance of the radio pager of the embodiment.

As illustrated in FIG. 1, the radio pager of the embodiment comprises a key input unit 10 for entering various data or commands, an antenna 90, a receiving unit 20, and a decoder 30 for receiving a paging request from a radio base station, a drive circuit 60, a display unit 70, and a speaker 80 for notifying an operator of the paging request, a control unit 40 for controlling each operation of these units, an ID-ROM 50 with the ID code of the same radio pager stored therein, and a photoelectric switch 100 and a cover switching detecting circuit 110 for detecting the opening and closing of the cover 120 provided in the case body of the radio pager. FIG. 1 shows only the characteristic components of the embodiment, while the description of the other general components is omitted there.

In the radio pager of this embodiment, when a paging message is transmitted from a radio base station, the receiving unit 20 receives it through the antenna 90 and the decoder 30 decodes the received message, in the same way as the conventional radio pager. The control unit 40 makes a comparison between the ID code attached to the received message and that one of the ID-ROM 50. If they are in accord with each other, the control unit 40 controls the drive circuit 60 so as to notify the operator of the message being received in a way of showing it on the display unit 70 as well as with a sound from the speaker 80. On setting the additional function, necessary data or command is entered with a key from the key input unit 10. Upon receipt of the input from the key input unit 10, the control unit 40 sets the corresponding additional function and registers the setting content into a given storage. The control unit 40 for controlling these operations is realized by a CPU controlled by a computer program and an internal memory such as a RAM or the like. The computer program for controlling the CPU, stored in a storage medium such as a magnetic disk, a semiconductor memory, or the like, is provided in the device. The function of the control unit 40 is realized by the CPU having the computer program loaded.

As illustrated in FIG. 2, the cover 120 is provided outside of the case body 130 of the radio pager in an openable way, so to cover and protect additional function setting switches 11 forming a part of the key input unit 10. A message confirming switch 12 forming another part of the key input unit 10 without being covered with the cover 120 is also provided outside of the case body 130 of the radio pager. FIG. 3 shows the state in which the cover 120 is closed. Generally, readout and confirmation of the received message is performed by the use of the message confirming switch 12, with the cover 120 closed as illustrated in FIG. 3. In registering the setting of the additional function, the setting item is registered by operating the additional function setting switches 11 with the over 120 open as illustrated in FIG. 2.

A photoelectric switch 100 is also provided in the portion to be covered with the cover 120 of the case body 130. The photoelectric switch 100 turns ON/OFF depending on the change in brightness caused by opening and closing the cover 120, and opening and closing of the cover 120 is detected by the cover switching detecting circuit 110. The control unit 40 monitors the state of the cover 120 through a detection signal of the cover switching detecting circuit 110. The radio pager operates depending on the result of detecting the state of the cover 120 by the cover switching detecting circuit 110. That is, when the cover 120 is closed, it operates in the general receiving mode of a paging request, and when the cover 120 is open, it operates in the setting mode of the additional function.

Next, in the radio pager of the embodiment, the description will be made with respect to an operation in receiving a paging request from a radio base station during the setting work of the additional function.

When setting the additional function, an operator opens the cover 120 so as to operate the additional function setting switches 11 as mentioned above. If receiving a paging request sent from a radio base station to this radio pager during the setting work, the radio pager of the embodiment accepts the paging request still under the operation mode of setting the additional function. More specifically, when the receiving unit 20 receives the paging request through the antenna 90, the message included in the paging request is decoded by the decoder 30, so to be sent to the control unit 40. Since it is under setting operation of the additional function at this time, the cover 120 is being open. The control unit 40 recognizes through the detection signal of the cover switching detecting circuit 110 that the cover 120 is being open. Holding the receiving notification of the paging request, the control unit 40 temporarily stores the message into the internal memory of itself.

When the cover 120 is closed after the completion of the setting work of the additional function, the cover switching detecting circuit 110 detects through the photoelectric switch 100 that the cover 120 is closed. The control unit 40 recognizes through the detection signal of the cover switching detecting circuit 110 that the cover 120 is closed, and then the transition occurs from the operation mode of setting the additional function to the general operation mode. The message stored into the internal memory is displayed on the display unit 70 via the drive circuit 60 and a sound indicating the receipt of the message is issued from the speaker 80, so as to notify an operator.

In the transition from the operation mode of setting the additional function to the general operation mode, the control unit 40 may be arranged in such a way that the notification could be performed only by the sound and that the notification with the message displayed on the display 70 could be performed by an operator using the message confirming switch 12. Alternatively, it is possible to arrange the control unit 40 in such a way that the notification with the message displayed on the display unit 70 as well as the notification with the sound could be performed by an operator using the message confirming switch 12, instead of automatic notification at the transition from the operation mode of setting the additional function to the general operation mode.

Figure 4:
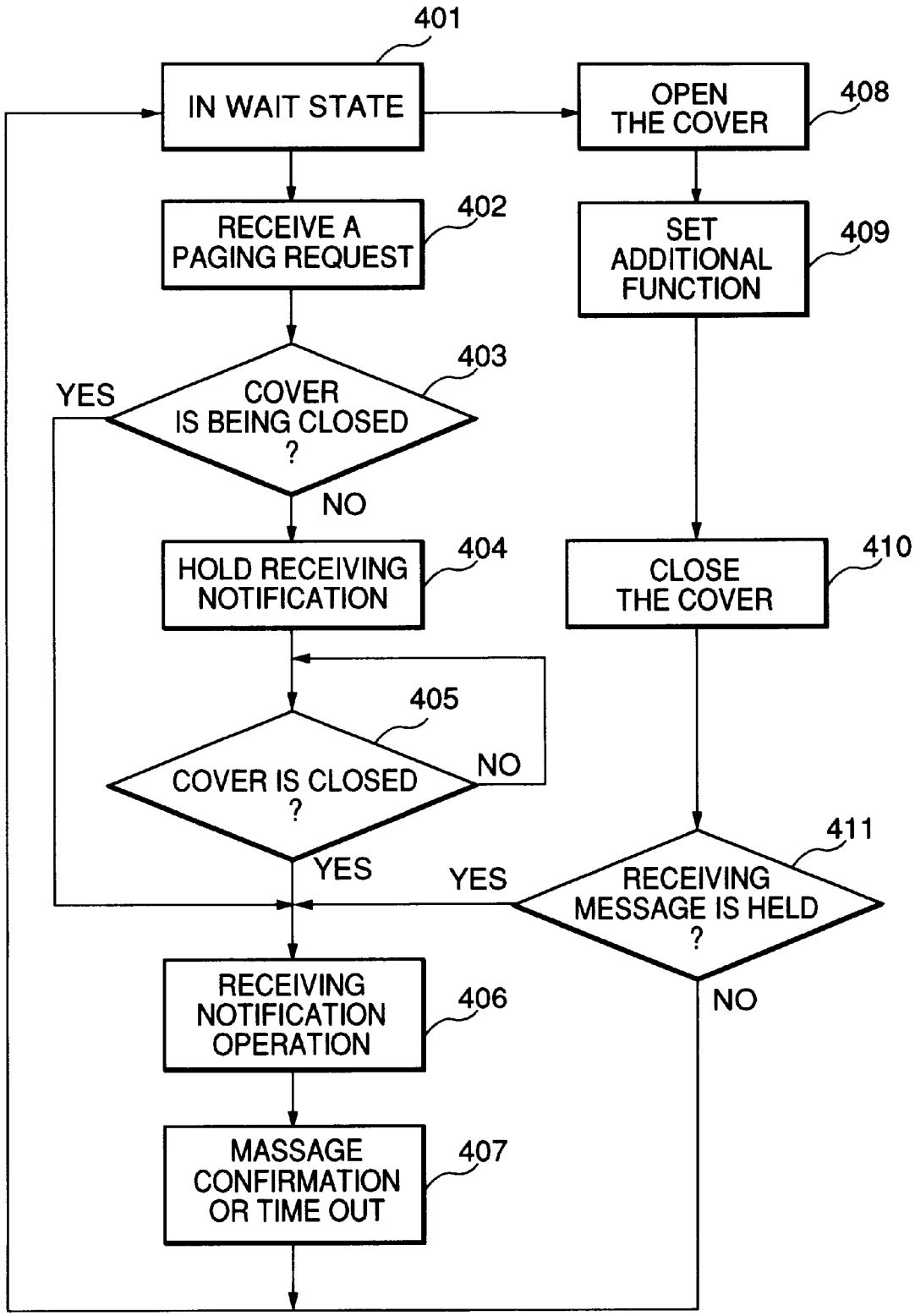
FIG. 4 is a flow chart showing an operation by the control unit of the embodiment.

A controlling operation of the radio pager by the control unit 40 will be described in detail with reference to the flow chart of FIG. 4.

Initially, the radio pager is in the wait state (Step 401). On receiving a paging request in this state (Step 402), the received message decoded by the decoder 30 is delivered to the control unit 40. Upon receipt of the received message, the control unit 40 checks the state of the cover 120 by the detection signal of the cover switching detecting circuit 110. Since the cover 120 is closed, the control unit 40 works the drive circuit 60 so that the received message can be notified via the display unit 70 as well as the speaker 80 (Steps 403 and 406). The control unit 40 terminates the notification operation provided that a confirming operation of the message is carried out by an operator, or provided that a predetermined notification time has passed, then returns the radio pager into the wait state (Step 407).

If the cover 120 is opened in the wait state, the control unit 40 turns to the operation mode of setting the additional function (Step 408).

If receiving a paging request with the cover 120 open (Step 402), the control unit 40, upon receipt of the received message decoded by the decoder 30, checks the state of the cover 120 by the detection signal of the cover switching detecting circuit 110. Since the cover 120 is open, the control unit 40 holds the receiving notification of the paging request (Step 404), waiting until the cover 120 is closed (Step 405).

While, when the cover 120 is closed (Step 410) after the completion of the setting work of the additional function (Step 409), the control unit 40 registers the setting content into the storage and terminates the operation mode of setting the additional function. Then, the control unit 40 checks if there is a pending received message stored in the internal memory.

If there is a pending message, the control unit 40 turns to the notification operation of Step 406 (Step 411). If there is no pending message, it returns the radio pager into the wait state.

Figure 5:
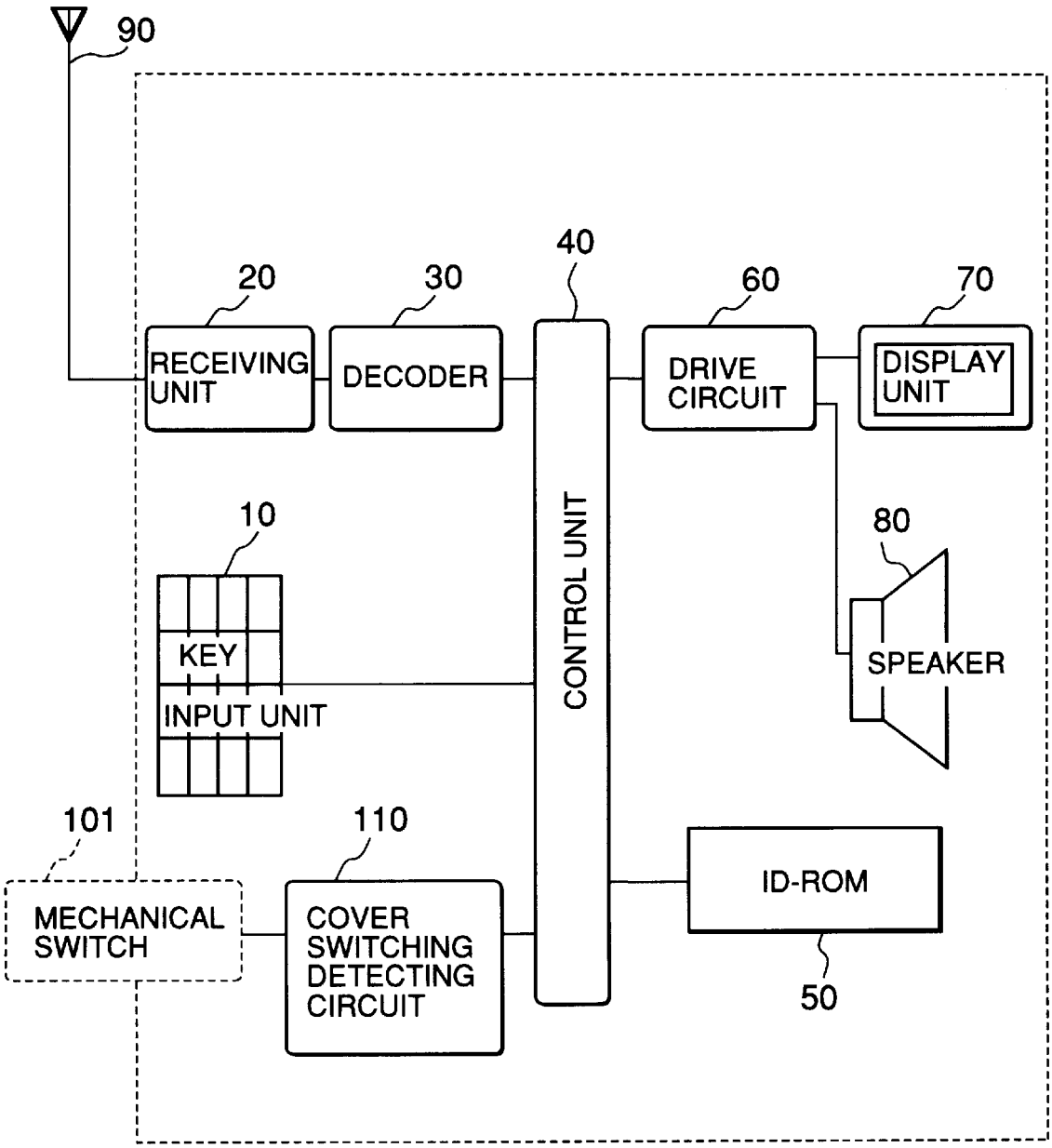
FIG. 5 is a block diagram showing an example of variation of the embodiment.
Figure 6:
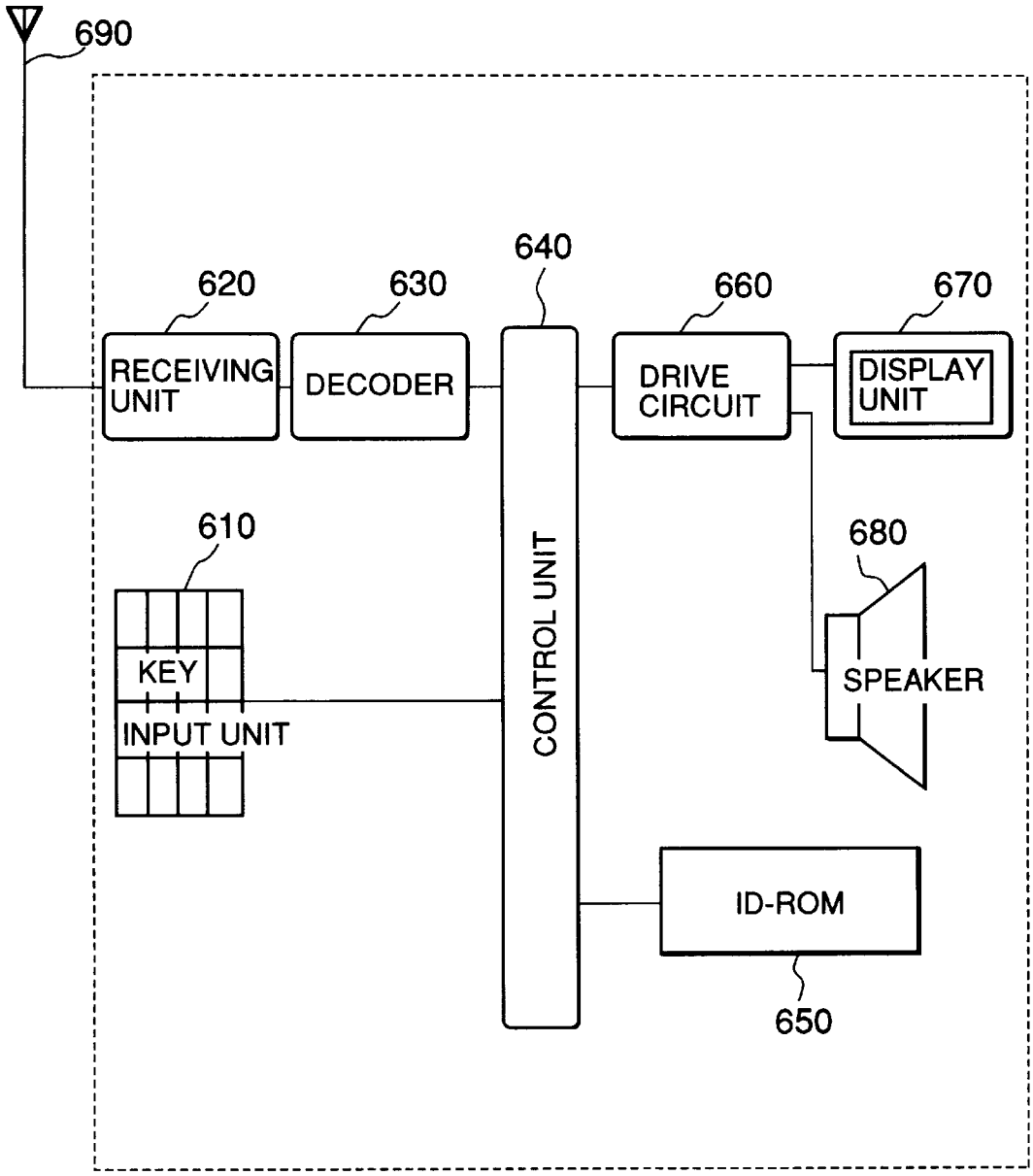
FIG. 6 (PRIOR ART)
FIG. 6 is a block diagram showing a construction of the conventional radio pager.

In the above-mentioned embodiment, the opening and closing state of the cover is optically detected by the use of the photoelectric switch 100. In stead of the photoelectric switch 100, a mechanical switch 101 may be used as illustrated in FIG. 5. The mechanical switch 101, for example, comprising a protrusive switch unit of a cylindrical shape in a retractable way at the position to be covered with the cover 120 of the case body 130, is constituted in such a way that opening the cover 120 releases the end portion of the cylindrical switch unit, allowing it to protrude, and that closing the cover 120 retracts the end portion of the cylindrical switch unit, thereby to detect the opening and closing state of the cover 120.

Alternatively, if the mechanical switch 101 is constituted by an appropriate switching means which can be operated by an operator himself at his proposal, in receiving the paging request during the setting work of the additional function, it is possible for him to decide the priority of the operation, in receiving the paging request during the setting work of the additional function, namely, whether the priority is to be given to the setting work with the receiving notification of the paging request being held, or to the operation of the paging request receiving notification with the setting work interrupted, according to the manner of an operator, his purpose, environment, or the like.

As set forth hereinabove, the radio paging receiver (radio pager) of the present invention, if receiving a paging request during the setting work of the additional function, can continue the setting work of the additional function while holding the receiving notification of the paging request, and after the completion of the setting work, it can perform the receiving notification of the paging request which has been held, thereby to avoid losing or voiding the setting work which has been done so far.

Additionally, according to the radio pager of the present invention, the receiving notification of a paging request during the setting work of the additional function can be performed by an operator using the message confirming switch, so that the operator can decide the timing of the receiving confirmation of the message, thereby using it flexibly according to the manner of an operator, his purpose, environment, or other condition.

Further, according to the radio pager of the present invention, since a switch is constituted as the cover switching detecting means so that it can turn ON/OFF by the opening and closing of the cover, or by an operator's manual operation at his proposal, the operator can decide whether the priority is given to the setting work with the receiving notification of the paging request held, or it is given to the receiving notification of the paging request with the setting work interrupted, thereby using it more flexibly according to the manner of an operator, his purpose, environment, or other condition.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A radio paging receiver having a function of receiving a paging request from a radio base station and an additional function set by an operator, comprising:

receiving means for receiving a paging request from said radio base station;

notification means for notifying an operator of the paging request;

key input means including an additional function setting switch for setting the additional function and a message confirming switch for confirming a received message;

cover provided on a case body in an openable way for covering at least said additional function setting switch;

cover switching detecting means for detecting opening and closing of the cover; and control means for controlling operation of the radio paging receiver, wherein said control means operates, depending on a detection result by said cover switching detecting means, in a first operation mode of actuating the notification means upon receipt of a paging request when said cover is closed, and in a second operation mode of holding or delaying actuating the notification means upon receipt of a paging request when said cover is open, to allow completion of the setting of the additional function in the second operation mode, and then returns to the first operation mode for actuating the notification means to notify an operator of the receipt of the paging request which has been held.

2. A radio paging receiver as set forth in claim 1, wherein said control means automatically starts the operation of the paging request receiving notification which has been held, on condition that it has turned from the second operation mode to the first operation mode by closing said cover which has been open.

3. A radio paging receiver as set forth in claim 2, wherein said control means selectively controls, according to a setting by an operator, the way of automatically starting the operation of the paging request receiving notification which has been held, on condition that it has turned from the second operation mode to the first operation mode by closing said cover which has been open, and the way of starting the operation of the paging request receiving notification which has been held, according to the operation of said message confirming switch by an operator, after turning from the second operation mode to the first operation mode by closing said cover which has been open.

4. A radio paging receiver as set forth in claim 2, wherein said control means, according to a setting by an operator, operates in the first operation mode and the second operation mode on the basis of a switching operation by an operator, and further said control means selectively controls, according to the setting by an operator, the way of automatically starting the operation of the paging request receiving notification which has been held, on condition that it has turned from the second operation mode to the first operation mode by closing said cover which has been open, and the way of starting the operation of the paging request receiving notification which has been held, according to the operation of said message confirming switch by an operator, after turning from the second operation mode to the first operation mode by closing said cover which has been open.

5. A radio paging receiver as set forth in claim 1, wherein said control means, after turning from the second operation mode to the first operation mode by closing said cover which has been open, starts the operation of the paging request receiving notification which has been held, according to the operation of said message confirming switch by an operator.

6. A radio paging receiver as set forth in claim 1, wherein said notification means includes a display means for displaying a received message and a sound notification means for notifying the receipt of a paging request with a sound, and said control means automatically starts the operation of the paging request receiving notification which has been held by the use of the sound by said sound notification means, on condition that it has turned from the second operation mode to the first operation mode by closing said cover which has been open, and after turning from the second operation mode to the first operation mode, it makes said display means display the received message according to the operation of said message confirming switch by an operator.

7. A radio paging receiver as set forth in claim 1, wherein said cover switching detecting means including photoelectric switch provided in the portion of the case body to be covered with said cover for detecting brightness of the space to be covered with said cover, and detecting circuit for judging whether said cover is being open or being closed depending on the brightness detected by said photoelectric switch.

8. A radio paging receiver as set forth in claim 1, wherein said control means, according to a setting by an operator, operates in the first operation mode and the second operation mode on the basis of a switching operation by an operator, and automatically starts the operation of the paging request receiving notification which has been held, on condition that it has turned from the second operation mode to the first operation mode by closing said cover which has been open.

9. A radio paging receiver as set forth in claim 1, wherein said control means, according to a setting by an operator, operates in the first operation mode and the second operation mode on the basis of a switching operation by an operator, and starts the operation of the paging request receiving notification which has been held, according to the operation of said message confirming switch by an operator, after turning from the second operation mode to the first operation mode by closing said cover which has been open.

10. A radio paging receiver having a function of receiving a paging request from a radio base station and an additional function set by an operator, comprising: receiving means for receiving a paging request from said radio base station; notification means for notifying an operator of the paging request; key input means including an additional function setting switch for setting the additional function and a message confirming switch for confirming a received message; cover provided on a case body in an openable way for covering at least said additional function setting switch; cover switching detecting means for detecting opening and closing of the cover; and control means for controlling operation of the radio paging receiver, wherein said control means operates, in a first operation mode of actuating the notification means upon receipt of a paging request and in a second operation mode of holding or delaying actuating the notification means upon receipt of a paging request, wherein according to a setting by an operator, said control means controls switching between the first operation mode and the second operation mode on the basis of a switching operation by an operator.

* * * * *